US011172736B1

(12) United States Patent
Cao et al.

(10) Patent No.: US 11,172,736 B1
(45) Date of Patent: Nov. 16, 2021

(54) LOCKING DEVICE

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Yan-Lei Cao, Zhengzhou (CN); Luo Gong, Zhengzhou (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/988,894

(22) Filed: Aug. 10, 2020

(30) Foreign Application Priority Data

May 14, 2020 (CN) ..... 202010409507.8

(51) Int. Cl.
*A44B 13/02* (2006.01)

(52) U.S. Cl.
CPC ..... *A44B 13/02* (2013.01)

(58) Field of Classification Search
CPC ..... A44B 13/02; F16G 11/101
See application file for complete search history.

(56) References Cited

U.S. PATENT DOCUMENTS 4,733,625 A * 3/1988 Allen ..... B63B 21/20 114/230.28
5,156,430 A * 10/1992 Mori ..... B66C 1/36 294/82.23
5,323,514 A * 6/1994 Masuda ..... F16G 11/101 24/115 G
5,345,657 A * 9/1994 Shimizu ..... F16G 11/101 24/115 G
5,430,914 A * 7/1995 Patterson ..... F16B 45/02 24/598.5
5,606,782 A * 3/1997 Patterson ..... F16B 45/02 24/598.5
5,867,877 A * 2/1999 Patterson ..... F16G 11/101 24/598.5
6,038,746 A * 3/2000 Anscher ..... F16G 11/101 24/115 G
6,360,408 B1 * 3/2002 Dykstra ..... F16B 45/04 24/115 G (Continued)

*Primary Examiner* — Robert Sandy
*Assistant Examiner* — Louis A Mercado
(74) *Attorney, Agent, or Firm* — ScienBiziP, P.C.

(57) ABSTRACT

A locking device includes a sleeve, an actuator, and a stopper. The sleeve defines a receiving cavity and an outlet communicating with the receiving cavity. An inner wall of the receiving cavity defines a sliding groove and a stopping groove. The actuator is provided in the receiving cavity. One end of the actuator is inserted in the outlet, and another end of the actuator extends out of the receiving cavity. The stopper is provided on the actuator. The actuator is configured to be rotated to switch the stopper between the sliding groove and the stopping groove. When the stopper resists in the stopping groove, the actuator is fixed in the sleeve. When the stopper is switched to the sliding groove, the actuator is pressed to slide along the sliding groove and extend out of the outlet.

11 Claims, 6 Drawing Sheets

(56) References Cited

U.S. PATENT DOCUMENTS

| | | | | |
|---|---|---|---|---|
| 7,013,684 | B2 * | 3/2006 | Hooks, Jr. | E05B 73/007 24/598.5 |
| 7,254,871 | B2 * | 8/2007 | Yoshiguchi | F16G 11/101 2/160 |
| 7,337,503 | B1 * | 3/2008 | Ashbrook | E06B 9/327 24/115 G |
| 2008/0098574 | A1 * | 5/2008 | Kim | F16G 11/101 24/132 WL |

* cited by examiner

LOCKING DEVICE

FIELD

The subject matter herein generally relates to a locking device for locking a hanging member.

BACKGROUND

Smart wearable devices are becoming more and more popular. For example, smart watches, bracelets, necklaces, and other products may require a lanyard for wearing on a body part. However, the existing lanyard connection is inconvenient for the operation and replacement of smart wearable devices, and a hanging object is prone to fall off the lanyard.

BRIEF DESCRIPTION OF THE DRAWINGS

Implementations of the present disclosure will now be described, by way of embodiments, with reference to the attached figures.

DETAILED DESCRIPTION

Figure 1:
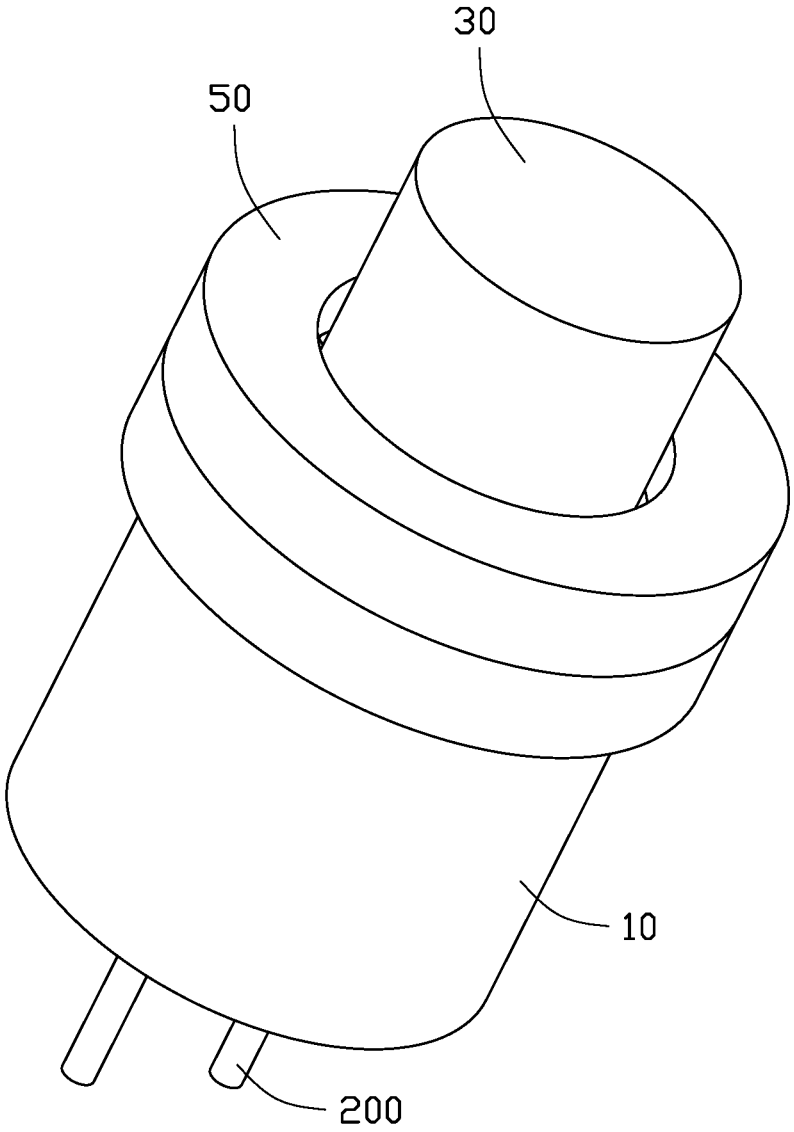
FIG. 1 is a perspective schematic diagram of a locking device according to an embodiment.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale, and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

Figure 2:
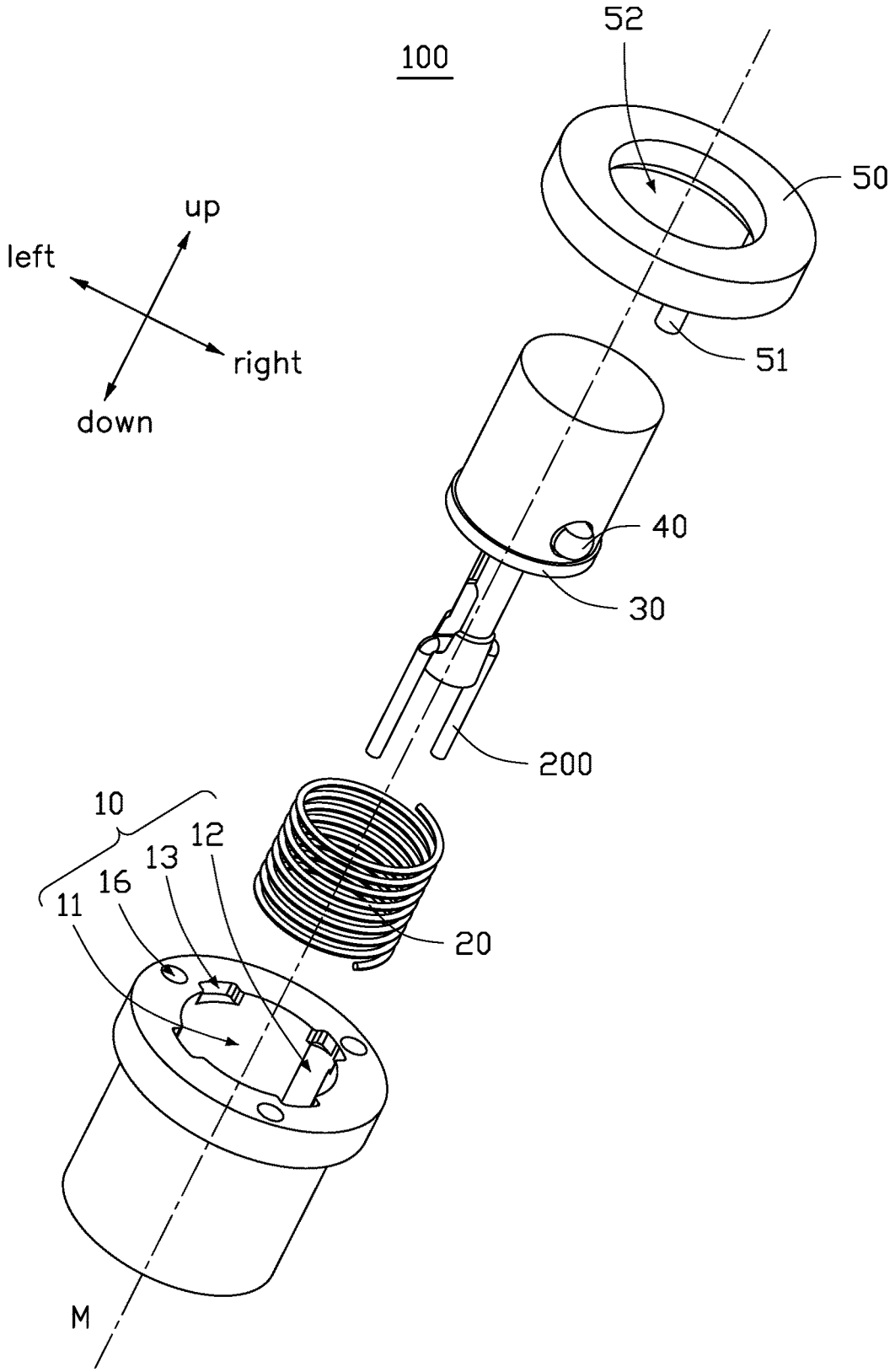
FIG. 2 is an exploded schematic diagram of the locking device shown in FIG. 1.

Referring to FIGS. 1 and 2, a locking device 100 includes a sleeve 10, an actuator 30, and a stopper 40. The sleeve 10 defines a receiving cavity 11, and an inner wall of the receiving cavity 11 defines a sliding groove 12 and a stopping groove 13. The sleeve 10 defines an outlet 14 (shown in FIG. 3) communicating with the receiving cavity 11. One end of the actuator 30 is inserted into the outlet 14, and another end of the actuator 30 extends out of the sleeve 10. The stopper 40 is provided on the actuator 30. When the actuator 30 is rotated, the stopper 40 can be switched between the stopping groove 13 and the sliding groove 12.

When the stopper 40 is received in the stopping groove 13, the actuator 30 is fixed in the sleeve 10, and the actuator 30 is used to lock a hanging member (not shown) in the outlet 14.

When the stopper 40 is received in the sliding groove 12, the actuator 30 is pressed to move along the sliding groove 12, and the actuator 30 extends out of the outlet 14 to release the hanging member.

Referring to FIGS. 1 and 2, the receiving cavity 11 is defined in a substantially central position of the sleeve 10, and the receiving cavity 11 extends in the sleeve 10 to a predetermined depth.

The sliding groove 12 is defined in the inner wall of the receiving cavity 11. In one embodiment, the sleeve 10 defines two sliding grooves 12 arranged opposite to each other, and the stopper 40 can slide in the sliding grooves 12.

The stopping groove 13 is defined at an upper end of the sleeve 10 and the edge of the receiving cavity 11. In one embodiment, the sleeve 10 defines four stopping grooves 13 arranged equidistantly around the sleeve 10. Two opposite stopping grooves 13 are in communication with the sliding grooves 12, so that when the stopper 40 rotates to the position of the two stopping grooves 13 in communication with the two sliding grooves 12, the stopper 40 can slide in the sliding grooves 12. When the stopper 40 rotates into the other two stopping grooves 13 not in communication with the two sliding grooves 12, the two stopping grooves 13 not in communication with the two sliding grooves 12 restrict the stopper 40 from sliding upward and downward.

It can be understood that, in other embodiments, only one or three of the sliding grooves 12 may be provided according to the structure of the stopper 40. Two stopping grooves 13 can be provided and arranged opposite to each other, and the sliding grooves 12 can directly extend from the upper end to the lower end of the receiving cavity 11.

The outlet 14 is defined at a central position of the lower end of the sleeve 10, and the diameter of the outlet 14 is smaller than the diameter of the receiving cavity 11.

Figure 3:
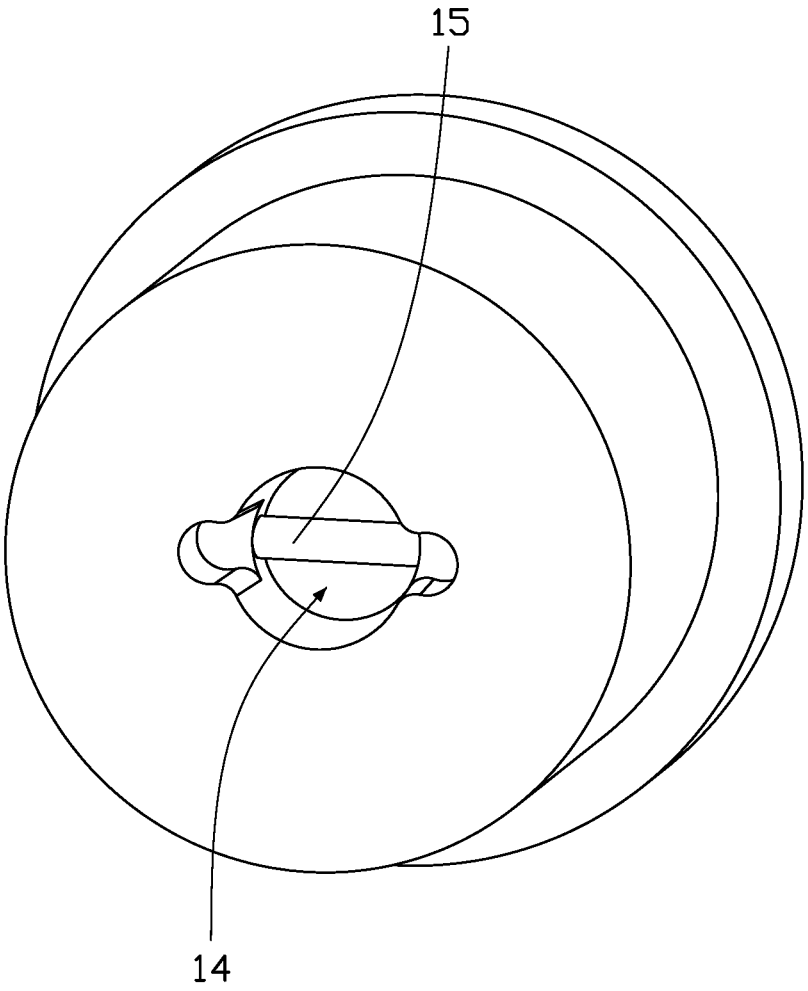
FIG. 3 is a perspective diagram of a sleeve shown in FIG. 2.

Referring to FIG. 3, in one embodiment, the sleeve 10 further includes a grabbing member 15 fixed on the inner wall of the outlet 14 and be perpendicular to an axis M of the outlet 14 to resist the actuator 30 when the actuator 30 is pressed down.

In one embodiment, the grabbing member 15 is substantially cylindrical. It is understandable that in other embodiments, the grabbing member 15 may adopt other shapes so as to resist the actuator 30. Further, the grabbing member 15 and the sleeve 10 may be an integral structure. In other embodiments, the grabbing member 15 is detachably provided on the sleeve 10.

Referring to FIG. 2, the locking device 100 further includes a first resilient member 20 received in the receiving cavity 11. Two ends of the first resilient member 20 abut against a lower wall of the receiving cavity 11 and the actuator 30, respectively. The first resilient member 20 is used to provide a restoring force to the actuator 30 so as to be able to drive the actuator 30 to move in the sliding grooves 12.

In one embodiment, the first resilient member 20 is a spring. It can be understood that, in other embodiments, the first resilient member 20 can be replaced with a torsion spring or another structure having a similar effect.

Figure 4:
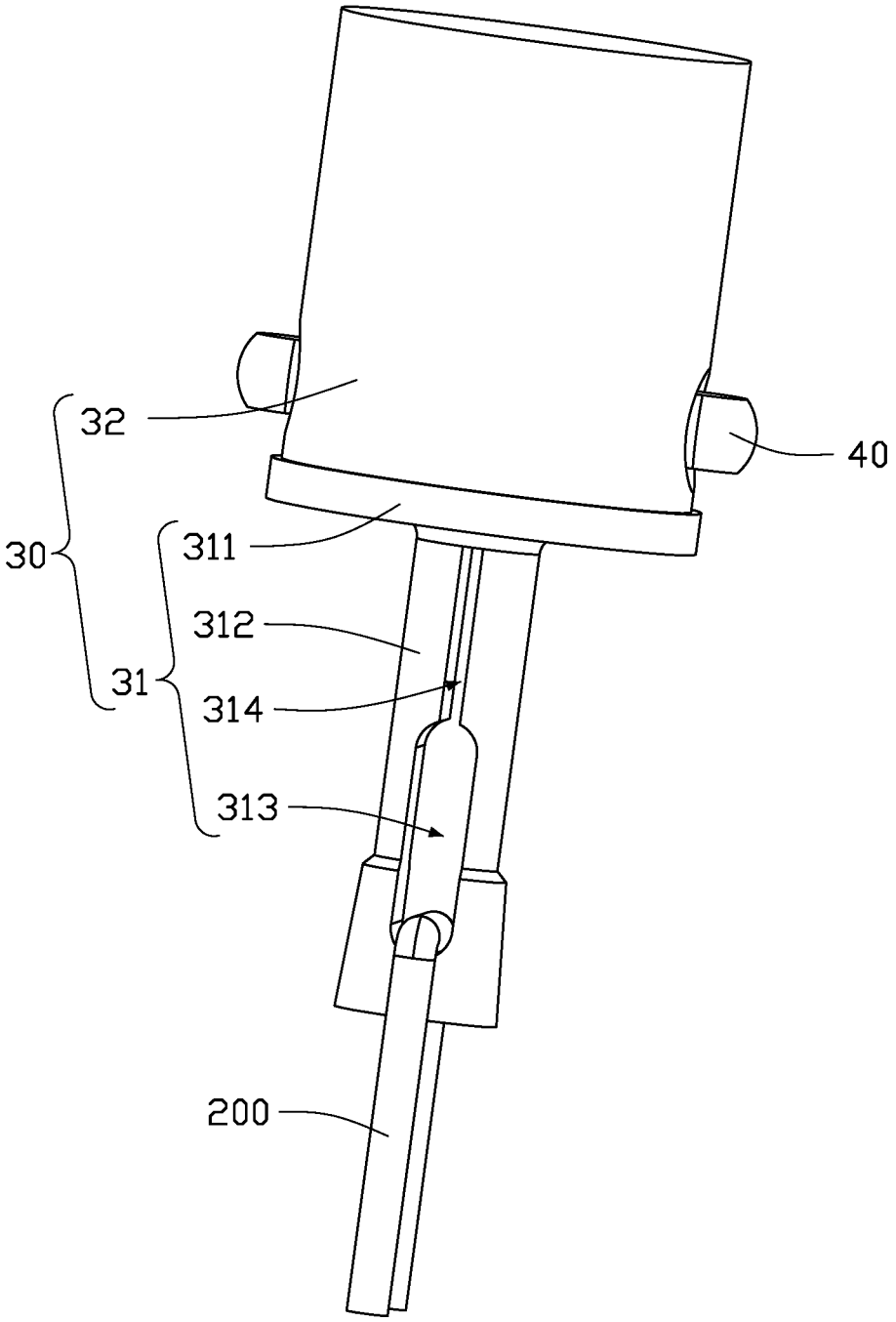
FIG. 4 is a perspective schematic diagram of an actuator, a stopper, and a lanyard shown in FIG. 2.

Referring to FIGS. 1 and 4, the actuator 30 includes a locking member 31 and a pressing member 32. The locking member 31 is received in the receiving cavity 11. One end of the locking member 31 is inserted into the outlet 14, and another end of the locking member 31 is connected to the pressing member 32. The pressing member 32 extends out of the sleeve 10.

Specifically, the locking member 31 includes a locking plate 311 and a hook 312. An upper end of the locking plate 311 is connected to the pressing member 32, and a lower end of the locking plate 311 is provided with the hook 312. The hook 312 is hooked on the hanging member.

In one embodiment, the locking plate 311 is a substantially circular plate provided in the receiving cavity 11. The locking plate 311 is used for transmitting a pushing force applied on the pressing member 32 to the hook 312 to push the hook 312 to extend out of the sleeve 10 from the outlet 14. It can be understood that the shape of the locking plate 311 is not limited to this, and the shape of the locking plate 311 matches the shape of the receiving cavity 11.

In one embodiment, the locking member 31 includes two hooks 312 symmetrically arranged on a lower end surface of the locking plate 311 to jointly lock the hanging member. A locking hole 313 is defined between the two hooks 312, and the hanging member is located in the locking hole 313. Specifically, each hook 312 defines an oblong groove, and when the two hooks 312 are symmetrically arranged, the two oblong grooves enclose the locking hole 313. When the actuator 30 does not extend out of the outlet 14, the grabbing member 15 is located in the locking hole 313.

Furthermore, an opening and closing hole 314 is defined between the two hooks 312 and at an upper end of the locking hole 313 and in communication with the locking hole 313. A cross-sectional area of the grabbing member 15 is larger than a cross-sectional area of the opening and closing hole 314. When the locking member 31 is pressed, the locking member 31 moves downward, and the grabbing member 15 abuts the two hooks 312 and is clamped in the opening and closing hole 314, thereby the two hooks 312 are opened to release and replace the hanging member.

It can be understood that, in other embodiments, the locking member 31 may include one hook 312 bent at a greater angle, so that one hook 312 can lock the hanging member, and the grabbing member 15 is correspondingly omitted.

Figure 5:
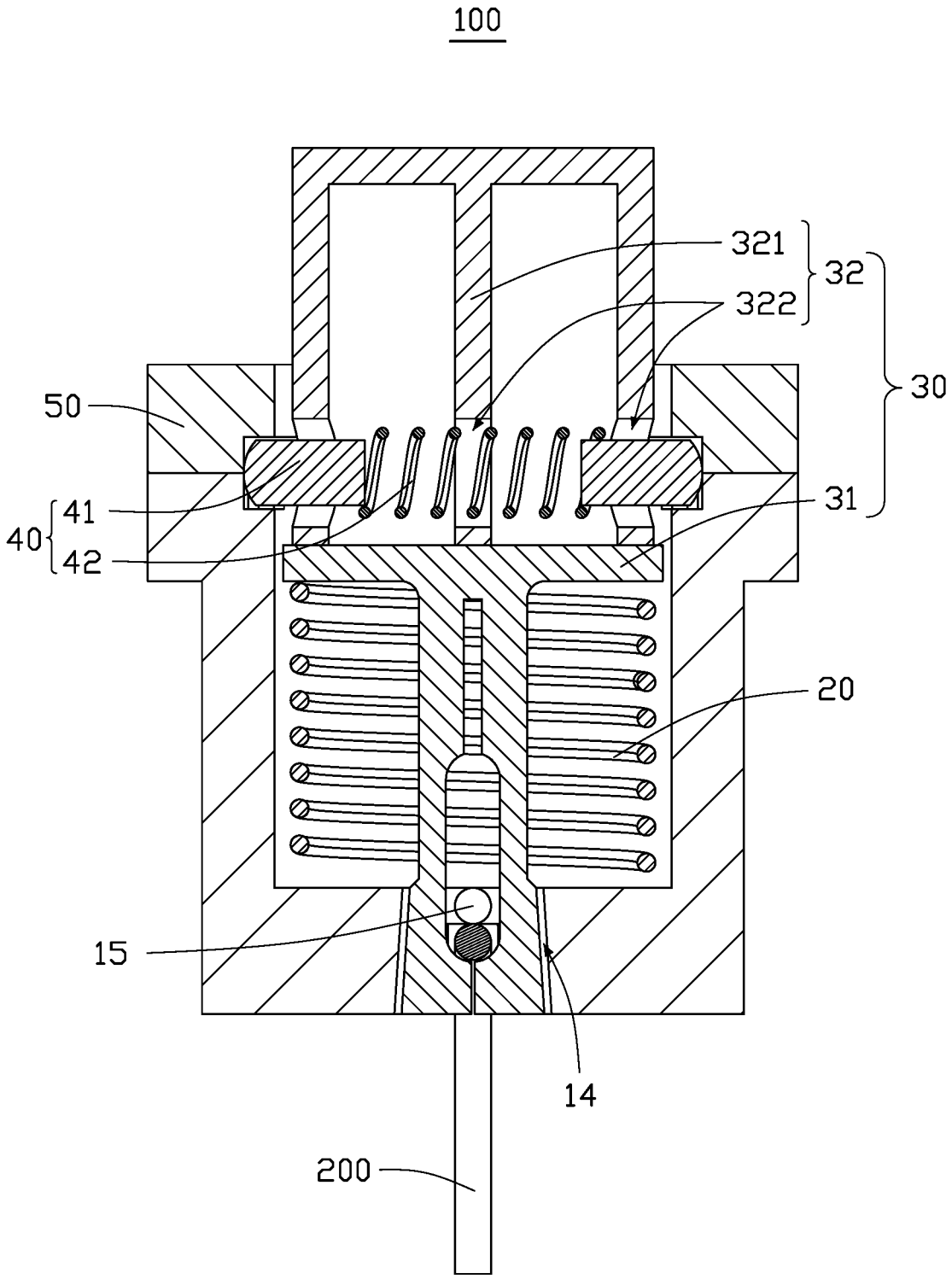
FIG. 5 is a cross-sectional diagram of the locking device shown in FIG. 1 in a locked state.
Figure 6:
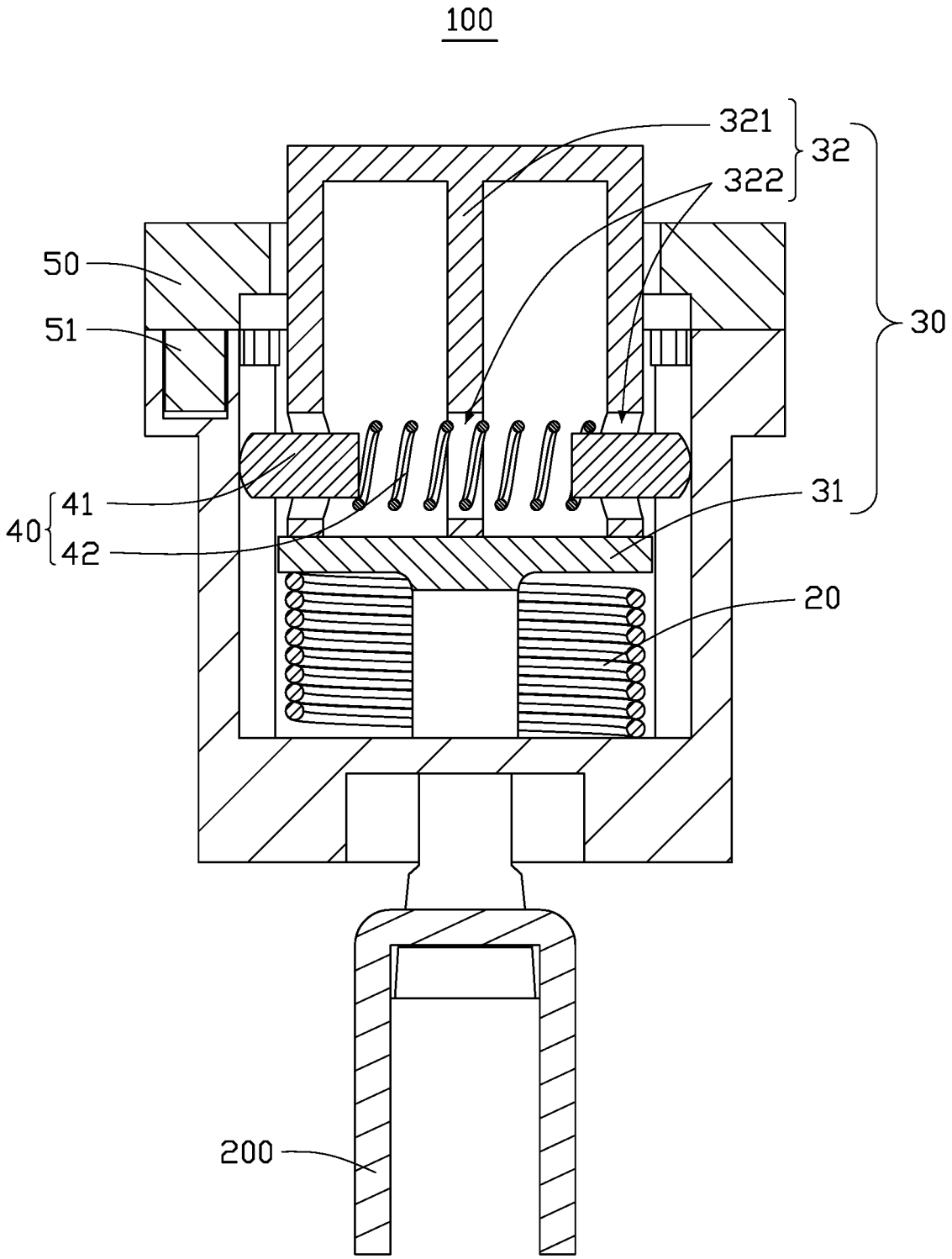
FIG. 6 is a cross-sectional diagram of the locking device shown in FIG. 1 in an unlocked state.

Referring to FIGS. 5 and 6, the pressing member 32 includes a bearing portion 321 extending from an inner wall of the pressing member 32, and the pressing member 32 defines a mounting hole 322. The mounting hole 322 penetrates through a peripheral wall of the pressing member 32 and part of the bearing portion 321. The stopper 40 is provided at a position of the mounting hole 322, and the size of the mounting hole 322 is the same as the size of a side of the stopper 40.

The bearing portion 321 is used to support the stopper 40 to prevent a position of the stopper 40 from shifting in the mounting hole 322 due to a heavy weight of the stopper 40.

Referring to FIG. 5, the stopper 40 includes a stopping block 41 and a second resilient member 42. The second resilient member 42 is sleeved on the stopper 40, and the second resilient member 42 passes through the mounting hole 322 in the bearing portion 321.

In one embodiment, the stopper 40 includes two stopping blocks 41. The two stopping blocks 41 are located in the mounting hole 322 of the pressing member 32, and two ends of the second resilient member 42 are respectively sleeved on the two stopping blocks 41. The bearing portion 321 supports the second resilient member 42 to further enable the second resilient member 42 to maintain a horizontal state when the two stopping blocks 41 are retracted, so that when the pressing member 32 is rotated, the two stopping blocks 41 are received in the two adjacent stopping grooves 13.

Further, the two stopping blocks 41 extend out of the pressing member 32 and resist in the stopping grooves 13. When the pressing member 32 rotates, the inner wall of the sleeve 10 squeezes the two stopping blocks 41, so that the two stopping blocks 41 retract along a compression direction of the second resilient member 42 until the two stopping blocks 41 are compressed, and the stopping blocks 41 rotate to the next stopping grooves 13. At this time, under the action of the elastic force of the second resilient member 42, the two stopping blocks 41 resist in the next stopping grooves 13.

Please refer to FIG. 5, in one embodiment, the locking device 100 further includes a cover 50 detachably connected to the sleeve 10. The cover 50 is disposed on the actuator 30 and makes the stopper 40 resist in the stopping grooves 13.

Specifically, the cover 50 is provided with a connecting portion 51, and the sleeve 10 defines a connecting hole 16 at a position corresponding to the connecting portion 51. The cover 50 is inserted into the connecting hole 16 through the connecting portion 51 to realize a detachable connection between the sleeve 10 and the cover 50. The cover 50 can be removed for maintaining the locking device 100.

A through hole 52 (shown in FIG. 2) is defined in a central position of the cover 50. The cross-sectional area of the through hole 52 is larger than the cross-sectional area of the pressing member 32 and smaller than the cross-sectional area of rotation of the stopper 40, so that the pressing member 32 can pass through the through hole 52, and when the stopper 40 extends out of the pressing member 32, the stopper 40 is resisted.

It is understandable that a connection manner of the sleeve 10 and the cover 50 is not limited to this, and any structure that enables the sleeve 10 and the cover 50 to be firmly connected and detachably connected can be used.

The locking device 100 is connected with a lanyard 200. In one embodiment, the lanyard 200 is connected to the hanging member.

A smart wearable device (not shown in the figures) may include the aforementioned locking device 100. The smart wearable device includes, but is not limited to, smart watches, bracelets, and necklaces. In one embodiment, the smart wearable device is the hanging member.

It is understandable that the type of the lanyard 200 is not limited to this. As in other embodiments, the lanyard 200 may also be a soft hook or the like.

Referring to FIG. 5, in a locked state, the two stopping blocks 41 respectively resist in the corresponding stopping grooves 13 to restrict the movement of the pressing member 32 and prevent the hanging member from falling off.

When the lanyard 200 needs to be replaced, the pressing member 32 is rotated, and the pressing member 32 drives the stopping blocks 41 to rotate. The stopping blocks 41 retract along the compression direction of the second resilient member 42 under pressure from the inner wall of the sleeve 10 until the stopping blocks 41 rotate to the position of the next stopping grooves 13. Then, the stopping blocks 41 are caused by the elastic force of the second resilient member 42 to resist in the stopping grooves 13.

At this time, the stopping blocks 41 are located at the upper end of the sliding grooves 12, and by pressing the pressing member 32, the stopping blocks 41 slide downward along the direction of the sliding grooves 12. The pressing member 32 pushes the locking member 31 to move downward, and the hooks 312 move out of the outlet 14 and continue to move downward. The grabbing member 15 moves upward in the locking hole 313 until the grabbing member 15 resists the lower end of the opening and closing hole 314 and is squeezed into the opening and closing hole 314 to open the hooks 312. At this time, the lanyard 200 can be replaced, as shown in FIG. 6.

After the lanyard 200 is replaced, the pressing member 32 is released, and the locking member 31 resets under the elastic force of the first resilient member 20 until the stopping blocks 41 resist in the stopping grooves 13.

When the pressing member 32 is rotated again, the stopping blocks 41 retract in the compression direction of the second resilient member 42 until the stopping blocks 41 resist in the next stopping grooves 13, and the locked state is achieved again.

In summary, the actuator 30 must be pressed and rotated to push the actuator 30 out of the outlet 14, so as to prevent the hanging member from falling off by accident.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A locking device comprising:

a sleeve defining a receiving cavity and an outlet communicating with the receiving cavity, an inner wall of the receiving cavity defining at least one sliding groove and at least one stopping groove;

an actuator provided in the receiving cavity, one end of the actuator inserted in the outlet, and another end of the actuator extending out of the receiving cavity;

at least one stopper provided on the actuator; and a first resilient member received in the receiving cavity; wherein:

two ends of the first resilient member respectively resist the sleeve and the actuator;

the actuator is configured to be rotated to switch the at least one stopper between the at least one sliding groove and the at least one stopping groove;

when the at least one stopper resists in the at least one stopping groove, the actuator is fixed in the sleeve; and when the at least one stopper is switched to the sliding groove, the actuator is pressed to slide along the sliding groove and extend out of the outlet.

2. The locking device of claim 1, wherein:

the actuator comprises a locking member and a pressing member;

the locking member is provided in the receiving cavity, one end of the locking member is inserted in the outlet, and another end of the locking member is coupled to the pressing member; and the pressing member extends out of the sleeve.

3. The locking device of claim 2, wherein:

the locking member comprises a locking plate and at least one hook;

the locking plate is coupled to the pressing member;

the at least one hook is located on a side of the locking plate facing away from the pressing member.

4. The locking device of claim 3, wherein:

the locking member comprises two hooks;

the two hooks cooperatively define a locking hole.

5. The locking device of claim 4, wherein:

the sleeve comprises a grabbing member provided at the outlet and located in the locking hole.

6. The locking device of claim 5, wherein:

the two hooks further cooperatively define an opening and closing hole in communication with the locking hole;

when the locking member is pushed out of the outlet, the grabbing member pushes open the opening and closing hole to open the two hooks.

7. The locking device of claim 2, wherein:

the pressing member defines a mounting hole; and the at least one stopper is provided in the mounting hole.

8. The locking device of claim 7, wherein:

the at least one stopper comprises at least one stopping block and a second resilient member;

the second resilient member is coupled to the at least one stopping block and causes the at least one stopping block to contract and extend in the mounting hole, which causes the at least one stopping block to contract in the pressing member or extend out of the pressing member.

9. A locking device comprising:

a sleeve defining a receiving cavity along an axis of the sleeve and an outlet communicating with the receiving cavity, the outlet defined in an end wall of the sleeve, an inner wall of the receiving cavity defining at least one sliding groove and at least one stopping groove, the at least one stopping groove defined in an end of the receiving cavity opposite the outlet, and the at least one sliding groove extending along the axis of the sleeve;

an actuator provided in the receiving cavity, one end of the actuator inserted in the outlet, and another end of the actuator extending out of the receiving cavity;

a stopper provided on the actuator; and a first resilient member received in the receiving cavity; wherein:

two ends of the first resilient member respectively resist the sleeve and the actuator;

the actuator is configured to be rotated to switch the stopper between the at least one sliding groove and the at least one stopping groove;

when the stopper resists in the at least one stopping groove, the actuator is fixed in the sleeve; and when the stopper is switched to the sliding groove, the actuator is pressed to slide along the sliding groove and extend out of the outlet.

10. The locking device of claim 9, wherein:

the actuator comprises a locking member and a pressing member;

the locking member is provided in the receiving cavity, one end of the locking member is inserted in the outlet, and another end of the locking member is coupled to the pressing member; and the pressing member extends out of the sleeve.

11. The locking device of claim 10, wherein:

the locking member comprises a locking plate and at least one hook;

the locking plate is coupled to the pressing member; and the at least one hook is located on a side of the locking plate facing away from the pressing member.

* * * * *